United States Patent [19]

Ketterer

[11] 4,152,857

[45] May 8, 1979

[54] MEANS FOR LOADING SMALL FIREARMS INCLUDING A BOX MAGAZINE AND CARTRIDGE CLIPS

[75] Inventor: Dieter Ketterer, Oberndorf, Fed. Rep. of Germany

[73] Assignee: Heckler & Koch GmbH, Fed. Rep. of Germany

[21] Appl. No.: 802,587

[22] Filed: Jun. 1, 1977

[30] Foreign Application Priority Data

Jul. 8, 1976 [DE] Fed. Rep. of Germany ..... 2630659

[51] Int. Cl.[2] ..... F42B 39/06; F41C 25/02

[52] U.S. Cl. ..... 42/88; 42/9; 42/50

[58] Field of Search ..... 42/18, 9, 6, 21, 50, 42/87, 88; 89/34, 33 B, 33 R

[56] References Cited

U.S. PATENT DOCUMENTS

| | | | |
|---|---|---|---|
| 578,931 | 3/1897 | Johnson | 42/88 |
| 580,176 | 4/1897 | Johnson | 42/88 |
| 2,659,173 | 11/1953 | Capito | 42/50 |
| 2,773,325 | 12/1956 | Hill | 42/50 |
| 2,882,635 | 4/1959 | Hill | 42/87 |
| 3,997,994 | 12/1976 | Kastner et al. | 42/9 |
| 4,004,363 | 1/1977 | Sackenreuter et al. | 42/9 |

FOREIGN PATENT DOCUMENTS

| | | | |
|---|---|---|---|
| 432448 | 3/1923 | Fed. Rep. of Germany. | |
| 1137350 | 9/1962 | Fed. Rep. of Germany | 42/88 |

*Primary Examiner*—Charles T. Jordan

[57] ABSTRACT

The invention relates to a loading arrangement for handfire-arms, in particular automatic rifles for firing caseless ammunition, comprising a magazine and a cartridge clip adapted to it. The cartridge clip retains the cartridges by two resilient tongues and is constructed as an insert for a container. Several containers are detachable interconnected.

The magazine comprises channels for the tongues and is provided with a one-way barrier at the front face, which is open over at least approximately the full cross-section. The one-way barrier allows the insertion of a cartridge clip having a plurality of cartridges into the magazine, tensioned against the follower spring. The one-way barrier further permits the removal of the clip while retaining the cartridges in the magazine. The cartridges are removed from the magazine perpendicular to the direction of insertion. The one-way barrier is constructed as a U-shaped stop spring.

22 Claims, 6 Drawing Figures

MEANS FOR LOADING SMALL FIREARMS INCLUDING A BOX MAGAZINE AND CARTRIDGE CLIPS

Figure 1:
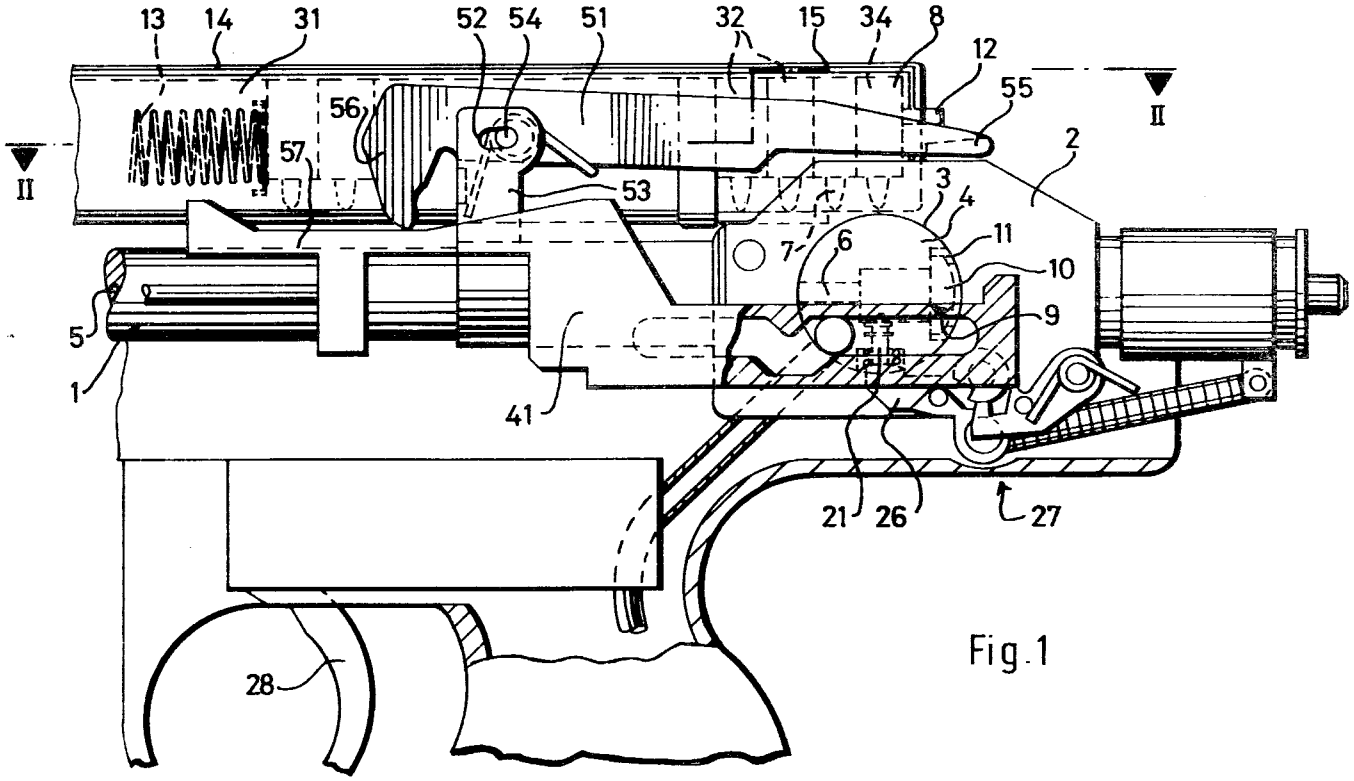

The invention relates to a loading arrangement for a hand fire-arm, in particular an automatic rifle for firing caseless ammunition, with a magazine located in or on the gun, for receiving, storing and supplying cartridges to the breech block, which is provided with a follower and follower spring and whereof one side face approximately at right-angles to the front face comprises an outlet orifice for the cartridges and with a cartridge clip facilitating filling of the magazine whilst tensioning the follower spring.

Automatic hand fire-arms have a high rate of fire, so that an adequate store of cartridges and a rapid supply of the cartridges in store must be ensured, if the advantage of the high rate of fire of automatic hand fire-arms is to be maintained. Interchangeable magazines, constructed in particular as bar magazines, have therefore gained significance for automatic hand fire-arms. These magazines generally consist of sheet metal and are provided with magazine lips at one end. Located inside the magazine housing is a spring-loaded follower, which pushes the cartridges inserted in the magazine housing in the direction of the magazine lips. These known magazines in fact provide an adequate number of cartridges and can also be exchanged sufficiently quickly. However, the cartridges have to be pushed into these magazines individually by hand in a troublesome manner, so that loading of a magazine requires a considerable length of time and therefore the marksman has to carry around with him the required ammunition in the form of full magazines. Due to the considerable weight of these magazines, the quantity of ammunition which a marksman can carry is limited. Also, these magazines are relatively expensive, because they must be sufficiently sturdy in order to operate with adequate safety. In this case, the magazines are provided with magazine lips, against which the respectively foremost cartridge bears under the action of the follower. The cartridges can only be introduced and removed in their longitudinal direction, i.e. at right-angles to the magazine in the direction in which the magazine lips form a guide. This is also the reason why filling of the magazine with cartridges is relatively troublesome and time-consuming.

In the case of a repeating rifle it is also known to provide magazines in the gun itself with a built-in follower and with magazine lips, but loading with cartridge clips is only possible with twin-row magazines, in which the clear spacing of the magazine lips is greater than the diameter of a cartridge. Nevertheless, the cartridges must be pushed into the magazine more or less individually and the time required for this is too great for an automatic rifle.

Finally, a rifle is also known with a built-in magazine and a magazine part which can be inserted, in which the magazine lips and follower are incorporated in the gun and a magazine shaft is provided with a lateral opening, in which the cartridges located in a packing together with the packing forming the magazine part can be inserted. However, in this case, the packing must be adapted exactly to the shape of the magazine. Since it must receive the packing, the magazine shaft must be larger than would be necessary solely for receiving cartridges. It is not of great importance if the magazine shaft projects outwards from the rifle, because then the magazine shaft can be used as an additional hand grip. However, the increase in the cross-section of the magazine shaft causes considerable disturbance if a bar magazine or drum magazine located parallel to the barrel is used.

The object of the present invention is to provide a loading arrangement consisting of a magazine and cartridge clip, which with little expenditure for the cartridge clip which can be used again without problems, facilitates filling of the magazine as rapidly as is possible in the rifle having a magazine with ammunition which can be inserted together with the packing, without having to tolerate the increase in cross-section of the magazine or magazine shaft which is inevitable in that case.

This object is fulfilled according to the invention in a loading arrangement of the aforesaid type due to the fact that the single row magazine is open over at least approximately the full cross-section at the front face and at this front face a one-way barrier is provided which allows the insertion, but not the removal of cartridges, that the magazine comprises two channels at right-angles to the surface of the front face, leading to the open front face and that the cartridge clip comprises two spring-loaded tongues retaining the cartridges and located on a front plate, which tongues can be inserted in the channels of the magazine.

The loading arrangement according to the invention, which is suitable both for bar magazines and, with an appropriately curved construction, for drum magazines, provides the marksman with the possibility of filling the magazine quickly and without problems, if necessary after removal from the gun. Thus, the capacity of the magazine is not limited to the capacity of a cartridge clip, because it is quite possible to introduce cartridges from several cartridge clips in succession with a corresponding filling length of the magazine. Since the front face of the magazine is open over virtually the entire cross-section and there are no magazine lips which hinder filling, the cartridges held in a cartridge clip can be introduced in seconds with tensioning of the follower spring. In practice, the cartridge clip thus consists solely of two tongues retaining the cartridges in a resilient manner, which tongues are arranged roughly parallel to each other. Therefore, a cartridge clip of this type can be produced at reasonable cost on the one hand and can be re-used on the other hand. In this case, the cartridge clip can be re-filled with cartridges without auxiliary means. The channels in the magazine make it possible to introduce the cartridge clip over approximately the full length of the tongues. Due to this, the cartridges are held reliably during the introduction process, in which case they are received by the cartridge guides in the magazine, without being able to vary their mutual position, before the cartridge clip is removed. The one-way barrier prevents the cartridges from being drawn out of the open front face of the magazine.

This one-way barrier can be constructed in very varied ways, for example in the manner of a clamping roller free wheel or a locking mechanism. In a preferred embodiment, the one-way barrier is constructed as a stop spring held in a recess in the magazine, whereby the edges of the recess, against which the stop spring bears, enclose a wedge angle opening in the insertion direction, whereas the opposing edges enclose an angle bringing about automatic locking and in particular are at right-angles to the insertion direction. This embodiment is particularly suitable for caseless ammunition with a square powder body. If conventional cartridges with a circular cross-section are used, then it must be ensured that the angle between the cartridge and edge of the recess opens in the insertion direction and that jamming occurs in the outlet direction, as is known in principle from the afore-mentioned free wheel.

The loading arrangement according to the invention is preferably used in automatic rifles for firing caseless ammunition. This caseless ammunition consists of a prismatic powder body or propellant body, at one end face of which the bullet embedded in the powder body projects. The cross-section of the powder body prism is generally a square with chamfered longitudinal edges. In a magazine for ammunition of this type, in order to prevent tilting of the ammunition and thus damage to the powder body which cannot withstand high mechanical stress, in a preferred manner, the magazine comprises longitudinal guide faces engaging the powder body, which faces guide the side and front faces of the powder body. Due to these two guide surfaces which are preferably present four times, tilting and thus local excess stress on the powder body is prevented from the beginning and troublefree operation of the gun is ensured, even with a high firing rate.

The spring-loaded tongues of the cartridge clip may be constructed in various ways, for example as wire springs with a circular or polygonal cross-section. Embodiments with wire springs are particularly suitable for ammunition with cases, where the wire springs engage in recesses in the case, for example the extractor edge, but certain objections oppose the mounting of caseless ammunition by wire springs. Therefore, in preferred embodiments of the invention, the spring-loaded tongues are constructed as leaf springs, which rest flat against lateral notches in the powder body. In this case, the dimensions of the lateral notch or recess provided in the powder body are such that the depth of the notch is approximately the thickness of the leaf spring and the width of the notch is equal to the width of the leaf spring. On the one hand, it is thus ensured that the spring-loaded tongues do not project much beyond the cross-section of the cartridges and on the other hand, tilting of the cartridges about an axis in the plane of the two spring-loaded tongues and at right-angles to the length of the tongues is prevented. Retention of the cartridges in a reliable position is thus achieved, which is conducive to reliable and rapid filling of the magazine. It will thus be understood that notches for the tongues can likewise be provided in the case of ammunition with cases and is also not limited to the construction of the tongues as leaf springs.

The stop spring provided as a one-way barrier is preferably constructed with a U-shape and the sides of the U, which form the actual one-way barrier, are provided with shoulders for the passage of the tongues of the cartridge clip. Due to these shoulders, it is unnecessary to provide one-way barriers located on both sides of the tongues.

The spring deflection which the sides of the U-shaped stop spring must accomplish is fixed in the case of predetermined dimensions of the cartridge, if a reliable operation is to be ensured Furthermore, for reasons of a reliable operation, the cross-section of the sides of the stop spring should also not fall short of predetermined dimensions. In addition, the spring force should only be so great that a reliable operation is ensured, without the force necessary for inserting the cartridges, with spreading of the sides of the stop spring and at the same time the stress on the powder body caused by the latter being too great. In order to satisfy all these requirements with the simplest production possibility of the stop spring, the yoke of the stop spring is preferably bent by 90° out of the plane of the sides and is in turn shaped as a W. Due to this extension of the resiliently stressed area of the stop spring, on the one hand, a relatively large cross section, which is constant over the length of the spring, can be used and on the other hand, the local bending stress is very low. Furthermore, this spring, whose sides are parallel to the open end face of the magazine and whose W-shaped yoke is located in the plane of one longitudinal wall of the magazine, can be located in a favourable manner. Finally, depending on the large length of the yoke, the sides move virtually parallel to each other.

Depending on the shape of the cartridges, conventional magazines have a slender rectangular cross-section. However, with caseless ammunition, the individual cartridges are much more compact and therefore the magazine cross-section may have the shape of a rectangle, whose length and breadth have a ratio of approximately 1:1 to 1:2.5. Whereas, in known magazines of very slender cross-section, the follower spring likewise has to have a slender rectangular cross-section, which leads to high deformation of the follower spring in the region of the corners, in the case of a loading arrangement according to the invention, the follower spring is constructed as a compression spring with circular cross-section and the outer diameter of the follower spring is greater than the width of the ammunition at right-angles to the force exerted by the follower spring. The enlargement of the magazine cross-section caused by the latter, at right-angles to the length of the cartridge and at right-angles to the feed direction of the cartridges is not troublesome if the magazine is constructed in a manner known per se as a bar magazine arranged parallel to and above or below the barrel, because without this the width of the gun is greater than the width of the magazine and therefore no further space is required by the magazine.

The cartridge clip may consist of a front plate and two tongues attached to the front plates. However, the two tongues are preferably made in one piece and connected to form a U by a yoke. Thus, in the simplest embodiment, the entire cartridge clip consists solely of a U-shaped leaf spring. However, a synthetic plate is injected or pressed around the yoke of the U and a handle is formed at the end face of this plate remote from the tongues. Thus, handling of the cartridge clip is simplified considerably. If, in addition, the plate is constructed as a cover for a container, the size of which is arranged to receive a cartridge clip filled with ammunition, a very practical loading system is thus created. The cartridge clip and container form a transportation unit which protects the ammunition until the magazine is filled with the latter. In order to facilitate handling of the container and on the one hand to combine a convenient size of the container with an adequate quantity of ammunition to be carried by the marksman on his body, several containers are preferably arranged side-by-side in a row with one surface located in a common plane attached to a film which can be torn off along the dividing line between two containers. Thus, a clip for attachment to the belt is provided or formed on the containers or on the tear-off film. Therefore, both individual containers as well as groups of containers held together by the film can be carried along on the belt. In addition, the tear-off film has the advantage that endless strips of containers can be produced and transported to the front, where they can be divided into varying lengths without any tools, as required. In addition, each marksman can divide the groups of containers as desired according to his own requirements. Due to this, he can attach groups of containers, which seem appropriate to him, at various points on his belt and he can also separate and throw away empty containers, which hinder him, by tearing them from full containers. The containers as well as the film preferably consist of a synthetic material suitable for this. The base of the container located opposite the front plate is provided with recesses for the ends of the tongues projecting above the cartridges. In the case of tongues located eccentrically on the synthetic plate, two pairs of such recesses are provided, in order that the cartridge clip can be introduced after being turned through 180°.

Further details and features of the present invention will become apparent from the following description of an embodiment of the invention, illustrated in the drawings, in conjunction with the claims.

Figure 2:
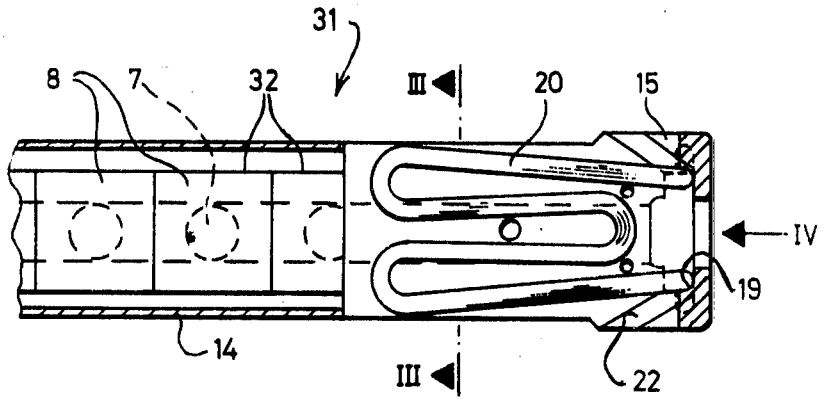
Figure 3:
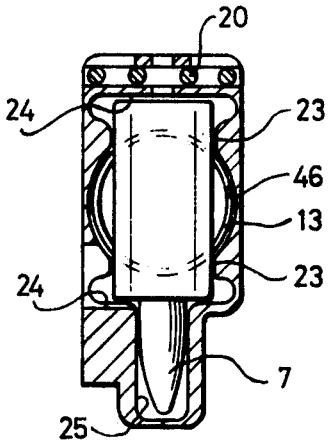
Figure 4:
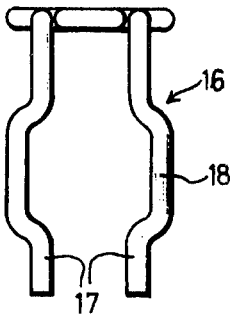
Figure 5:
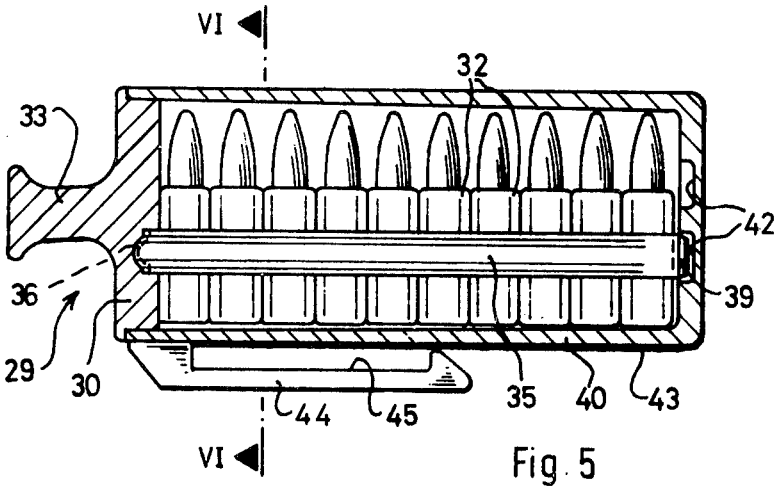
Figure 6:
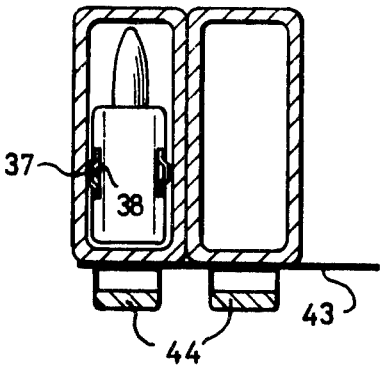

FIG. 1 shows partly in side view and partly in sectional view, the breech and magazine area of an automatic rifle equipped with a magazine according to the invention, FIG. 2 is a longitudinal section through the magazine on line II—II of FIG. 1, FIG. 3 is a section on line III—III of FIG. 2, FIG. 4 is a view of a stop spring in the direction of arrow IV of FIG. 2, FIG. 5 shows partly in longitudinal section, partly in elevation, a cartridge clip provided with ammunition and inserted in a container and FIG. 6 is a section on line VI—VI of FIG. 5.

The example illustrated in the drawing is an automatic rifle which is intended for firing cartridges without cases. Located in a part 2 fixed to a barrel 1 is a cylindrical bore 3, whose axis extends at right-angles to the axis of the barrel and intersects the axis of the barrel. Mounted in this bore is a cylindrical breech mechanism part 4 which is able to tilt about the axis of the bore 3. In the drawing, the breech mechanism part 4 is shown in the firing position, in which a cartridge chamber machined in the breech mechanism part aligns with the bore 5 of the barrel 1. The cartridge chamber comprises a front section 6 for receiving the point of a bullet 7, which projects from a propellant or powder body 8 of a caseless cartridge inserted in a cartridge chamber 9. At the rear, the cartridge chamber is provided with an enlarged section 10, in which a cylindrical sealing sleeve 11 is inserted. A firing pin 21 mounted in a transverse bore in the breech mechanism part 4 is directed approximately radially with respect to the bullet 7 and is located opposite a side face of the propellant body 8 in the region of the bullet 7 projecting into the propellant body. At this point, an ignition mass is embedded in the propellant body 8, which mass is supported by the bullet. A hammer 26 for initiating a shot strikes the rear end of the firing pin 21, which hammer co-operates in the conventional manner with the members of a trigger device 27, which is in turn in operative connection with a trigger 28 not shown in detail.

For loading the gun, the breech mechanism part 4 can be tilted through 90° into a loading position, in which the cartridge chamber 9 is at right-angles to the axis of the bore 5 of the barrel 1, whereby the section 10 of the cartridge chamber 9 faces a magazine 31 located above the barrel 1, parallel to the latter. This magazine 31 is a bar magazine, in which cartridges 32 consisting of the propellant body 8, the ignition mass and the bullet 7 are arranged such that they are at right-angles to the firing direction and the free points of the bullets 7 point to the axis of the barrel. The cartridge 34 respectively foremost in the magazine, prepared for the next shot (which is located at the end of the magazine remote from the muzzle) aligns with the cartridge chamber 9 in the breech mechanism part 4, when the breech mechanism part 4 is located in the loading position. For this, a stop 12 located in the gun is provided, against which the cartridge 34 bears under the action of a follower spring 13. The stop 12 projects somewhat into the magazine through the open end face of the magazine 31. The magazine 31 comprises an elongated housing 14 on whose base (not shown) the follower spring 13 is supported and at whose end opposite the base a lip member 15 is located.

Serving to supply the respectively foremost cartridge 34 from the magazine 31 or lip member 15 into the cartridge chamber 9 of the breech mechanism part 4 located in the loading position is a loading lever 51, which is displaceable in the longitudinal direction of the magazine in a slot 52, parallel to the magazine 31, of a stationary bearing part 53 and is mounted to tilt about an axis parallel to the axis of the breech mechanism part 4. The loading lever 51 is located beside the magazine 31 and at one end comprises a lateral projection 55 and is provided with a pivot pin 54, which is able to move in the slot 52. At the end opposite the projection 55, the loading lever 51 comprises an arm 56, which co-operates with a control cam 57 on a slide 41 serving to tilt the breech mechanism part 4. The slide 41 is actuated by a gas pressure loading device known per se (not shown). The cartridge 34 respectively located opposite the cartridge chamber 9 is introduced into the breech mechanism part 4 by the loading lever by means of the projection 55.

On its front end face, to which the arrow IV in FIG. 2 points, the magazine 31 is open over the entire cross-section of the cartridges 32. Due to this, the cartridges 32 can be introduced into the magazine from the end face either if the part 2 is appropriately hollow and the loading lever 51 can be swung out or if the magazine 31 is removable or is arranged in the gun so that it can be swung away from the part 2 at least in the region of the part 2. Located in the lip member 15 is a stop spring 16, which consists of a spring steel wire having a circular cross-section and whose free resilient sides 17 are each provided with an outwardly directed shoulder 18. The yoke of the U-shaped stop spring 16 is bent through 90° out of the plane of the sides 17 and is in the shape of a W, as shown in FIG. 2. The respectively foremost cartridge 32 bears against the sides 17 under the action of the follower spring 13. In this case, the sides 17 are pressed against inclined surfaces 19, which enclose a wedge angle, which brings about automatic locking, so that the sides 17 cannot be pushed outwards by the propellant body 8 of the cartridge 34. The W-shaped yoke 20 of the stop spring 16 is located in a recess in the lip member 15, parallel to the axis of the barrel 1. Provided opposite the areas of the sides 17 which are not offset are inclined surfaces 22 on the lip member 15, which cause spreading of the two sides 17 when a force is exerted in the direction of arrow IV on the sides 17. Therefore, if a cartridge 32 is introduced into the magazine in the direction of arrow IV, then the propellant body 8 pushes the sides 17 outwards and can be inserted in the magazine. After the propellant body 8, the sides 17 return to the position shown, in which they prevent withdrawal of the cartridge 34 in a direction opposed to the arrow IV of FIG. 2.

In the magazine 31, the cartridges 32 are guided by guide surfaces 23 bearing against the sides of the propellant body 8. Guide surfaces 24 are also provided, against which the cartridges 32 bear by the end faces of the propellant body 8. The bullets 7 are located in a channel-like recess 25 in the magazine 31 at a distance from adjacent surfaces. The guide surfaces 23 are respectively located in short areas in the longitudinal direction of the cartridge. Provided between the guide surfaces 23 bearing on the same side of the cartridge is a bulge 46 in the shape of a section of a cylinder, which guides the follower spring 13.

In order not to have to insert the cartridges 32 in the magazine 31 individually, which is naturally possible, even if time-consuming, a cartridge clip 29 has been developed, which comprises a synthetic plate 30 with a handle 33 formed on one side and tongues 35 projecting at right-angles on the other side. The tongues 35 are made in one piece and interconnected by a yoke 36 moulded in the synthetic plate 30. The tongues 35 consist of a resilient strip-like flat material, which for reinforcement is provided with an outwardly curved longitudinal reinforcing fin 37. The propellant bodies 8 of the cartridges 32 are provided on two opposite sides with recesses or notches 38, whose depth is approximately equal to the depth of the tongues 35 and whose width is equal to the width of the tongues 35. Due to this, the powder bodies, against which the tongues 35 bear with mutual pre-tension are held in a secure position and can only be removed or withdrawn in the longitudinal direction of the tongues 35. At the free ends, the tongues 35 are provided with transverse reinforcing fins 39 directed at right-angles to the longitudinal reinforcing fins 37, which transverse fins 39 curve inwards and on the one hand facilitate insertion of the cartridges in the longitudinal direction of the tongues 35 owing to the inclined position of the ends of the tongues 35 and on the other hand positively prevent unintentional and undesirable displacement of the cartridges in the longitudinal direction of the tongues towards the end of the tongue, when the cartridge clip has been filled.

For insertion of the ten cartridges of a full cartridge clip 29, the latter is gripped by the handle 33 and in the region of the shoulders 18, the distance between which is somewhat greater than the distance between the outer sides of the two tongues, the free ends of the tongues 35 are inserted in the magazine in the longitudinal direction until the synthetic plate 30 comes to bear against the end face of the lip member 15, in which case the follower spring 13 is compressed. During the subsequent withdrawal of the cartridge clip 29, the sides 17 engage behind the foremost cartridge 34 in the extraction direction and hold the latter secure. For this, the propellant bodies 8 are preferably chamfered along their longitudinal edges.

Since a magazine 31 preferably has a carrying capacity which is a multiple of a cartridge clip 29 having a convenient size, several cartridge clips can be emptied one after the other into the magazine.

The cartridge clips can be filled very easily both manually and by machine. In order to protect the cartridges 32 located in the cartridge clip 29, from damage and other influences, whilst being transported and carried by the marksman, a container 40 is provided, which is open on one side and can be closed by the synthetic plate 30 as a lid. Provided in the base of the container are recesses 42 for receiving the free ends of the tongues 35 provided with the transverse reinforcing fins 39. Preferably, several containers 40, with their largest surface adjoining each other, are placed side-by-side and interconnected in a detachable manner by a tear-off film 43 located on one arrow longitudinal side. The film 43 and container 40 may be connected by sticking or welding or the like. Also provided or formed on the container 40 or on the foil 43 is a clip 44 open at the side remote from the handle 33, which clip comprises an opening 45 for the marksman's belt. By means of the clips 44, a number of containers 40 determined by tearing off the foil 43, can be attached to the belt and carried along comfortably in this way. The empty cartridge clips can either be reinserted in the container or, however, like the container, thrown away, if they are troublesome during fighting.

I claim:

1. A system for loading a hand gun with cartridges comprising a magazine for feeding said cartridges in association with said gun, said magazine having an elongated body defining a channel for receiving and storing a plurality of said cartridges in side by side arrangement, said channel being open at one end for the insertion of said cartridges and having barrier means at said one end facilitating entrance of and preventing removal of said cartridges, and spring means for normally biasing said cartridges within said magazine against said barrier means, a clip comprising a handle and a pair of tongues resiliently secured at one end to said handle extending outwardly therefrom to embrace and hold a plurality of cartridges in side by side arrangement, said magazine body having a pair of opposed recesses running longitudinally of said channel for receiving said tongues to thereby permit insertion and removal of said clip from said channel.

2. The system according to claim 1, wherein said barrier is formed of a bent spring member and said magazine is provided with a recess for receiving said bent spring member, the edges of the recess against which the bent spring member bears defines a wedge angle opening in the direction of insertion of said cartridge, but edges opposite thereto define an angle causing said bent spring member to automatically occlude said opening and bar the removal of said cartridges.

3. The system accordng to claim 2, wherein the cartridges are caseless and have a prismatic propellant body, and a bullet embedded in one face thereof, said magazine including longitudinal guide surfaces engaging the propellant body.

4. The system according to claim 3, wherein the tongues are leaf springs having at least one longitudinal flat strip adapted to bear against said propellant body.

5. The system according to claim 4, wherein said leaf spring and the propellant body of said cartridges are formed with cooperating lateral recesses and notches for interengagement.

6. The system according to claim 2, wherein the barrier spring member is U-shaped, the sides forming said U-shape being provided with outwardly directed shoulders for the passages of the tongues of the cartridge clip.

7. The system according to claim 6, wherein the central yoke of said barrier spring member is bent 90° out of the plane of the side thereof and is in turn W-shaped.

8. The system according to claim 3, wherein the cartridge biasing spring is a compression spring and includes a wall member, the diameter of which is greater than the width of the propellant body.

9. The system according to claim 3, wherein the tongues of said clip are formed in one piece and have a connecting yoke member, said yoke member being secured in said handle.

10. The system according to claim 3, wherein said handle of said clip is formed of a unitary molded plastic and said tongues are embedded therein.

11. The system according to claim 3, including a container for said clip, said container comprising an envelope adapted to cover said cartridges and tongues, said handle forming the closure for said envelope.

12. The system according to claim 11, including frangible means for securing a plurality of said containers in abutting relationship.

13. The system according to claim 3, including means for attaching said clip to a belt, said means being formed on said handle.

14. The clip according to claim 4, wherein said leaf spring and side walls of said cartridges are formed with cooperating lateral recesses and notches for interengagement.

15. A caseless cartridge for use with the clip of claim 14 comprising a parallelepiped propellant of compressed powder having a notch formed on opposite sides of said propellant for cooperation with one recess in the tongue of the clip.

16. A clip for holding a plurality of cartridges each having a powder body and bullet embedded therein comprising a rigid handle member and a pair of elongated substantially rigid tongues extending parallel to each other for receiving and engaging the powder body of said cartridge in a single row side by side, said tongues having one end resiliently secured to said handle member and having the other end formed with means for releasably securing said cartridges in place.

17. The clip according to claim 16, wherein said tongues are leaf springs having at least one longitudinal flat strip adapted to bear against said propellant body.

18. The clip according to claim 16, wherein the tongues of said clip are formed in one piece and have a connecting yoke member, said yoke member being secured in said handle member.

19. The clip according to claim 16, wherein said handle member of said clip is formed of a unitary molded plastic and said tongues are embedded therein.

20. The clip according to claim 16, including a container for said clip, said container comprising an envelope adapted to cover said cartridges and tongues, said handle member forming the closure for said envelope.

21. The clip according to claim 20, including frangible means for securing a plurality of said containers in abutting relationship.

22. The clip according to claim 16, including means for attaching said clip to a belt, said means being formed on said handle member.

* * * * *